United States Patent [19]

Nachbur et al.

[11] 4,243,418

[45] Jan. 6, 1981

[54] COMPOSITIONS FOR FIREPROOFING POLYESTER FIBER MATERIALS WITH SUBSTITUTED SULPHURYLAMIDES

[75] Inventors: Hermann Nachbur, Dornach; Armin Hiestand, Binningen; Peter Rohringer, Schönenbuch, all of Switzerland

[73] Assignee: Ciba-Geigy Corporation, Ardsley, N.Y.

[21] Appl. No.: 944,662

[22] Filed: Sep. 21, 1978

Related U.S. Application Data

[62] Division of Ser. No. 808,006, Jun. 20, 1977, Pat. No. 4,128,687.

[30] Foreign Application Priority Data

Jun. 25, 1976 [CH] Switzerland ..... 8153/76

[51] Int. Cl.[3] ..... C09K 3/28

[52] U.S. Cl. ..... 106/18.22; 252/8.1

[58] Field of Search ..... 106/15 FP, 18.22; 252/8.1; 260/556 N

[56] References Cited

U.S. PATENT DOCUMENTS

| | | | |
|---|---|---|---|
| 2,829,038 | 4/1958 | Ochsner | 260/556 N |
| 2,867,658 | 1/1959 | Frick | 260/556 N |
| 3,143,549 | 8/1964 | Lafferty et al. | 260/556 N |
| 3,318,952 | 5/1967 | Houlihan | 260/556 N |
| 3,401,097 | 9/1968 | Merker et al. | 260/556 N |
| 3,509,211 | 4/1970 | Ilvespaa et al. | 260/556 N |
| 3,891,703 | 6/1975 | Catt et al. | 260/556 N |

FOREIGN PATENT DOCUMENTS

| | | | |
|---|---|---|---|
| 1493486 | 11/1969 | Fed. Rep. of Germany | 260/556 N |

*Primary Examiner*—Joseph L. Schofer
*Assistant Examiner*—Maria S. Tungol
*Attorney, Agent, or Firm*—Prabodh I. Almaula; Edward McC. Roberts

[57] ABSTRACT

A process for fireproofing polyester fibers is provided in which a substituted mono- or disulphurylamide of the formula

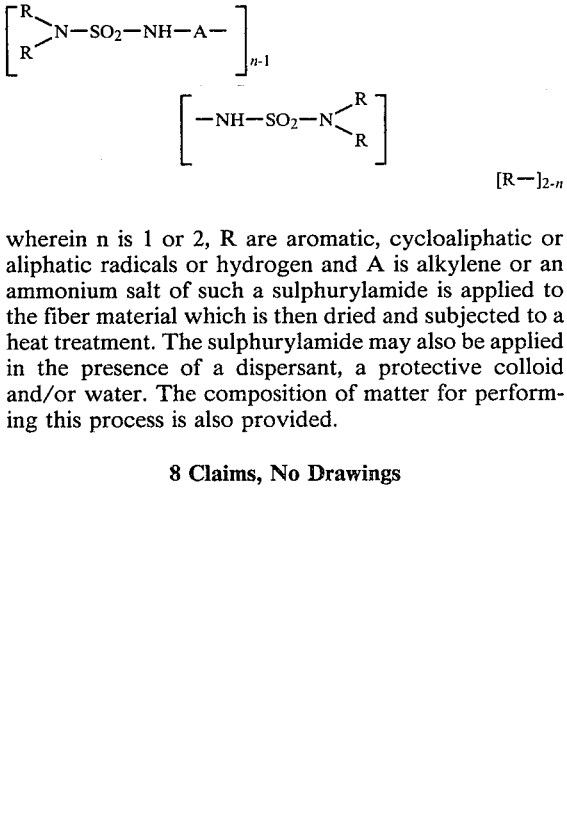

wherein n is 1 or 2, R are aromatic, cycloaliphatic or aliphatic radicals or hydrogen and A is alkylene or an ammonium salt of such a sulphurylamide is applied to the fiber material which is then dried and subjected to a heat treatment. The sulphurylamide may also be applied in the presence of a dispersant, a protective colloid and/or water. The composition of matter for performing this process is also provided.

8 Claims, No Drawings

COMPOSITIONS FOR FIREPROOFING POLYESTER FIBER MATERIALS WITH SUBSTITUTED SULPHURYLAMIDES

This is a division of application Ser. No. 808,006 filed on June 20, 1977 now U.S. Pat. No. 4,128,687.

The invention relates to a process for fireproofing fiber materials made from polyester, which process comprises treating these materials with a preparation containing at least one substituted sulphurylamide which is optionally present as the ammonium salt and which corresponds to the formula

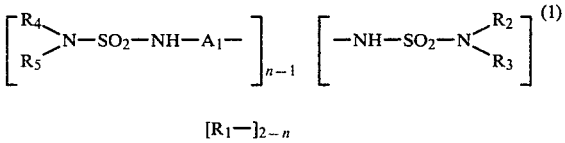

(1)

wherein n is 1 or 2 and, if n is 2, $A_1$ represents alkylene having 2 to 9 carbon atoms or phenylene, $R_2$, $R_3$, $R_4$ and $R_5$ each represent alkyl having 1 to 4 carbon atoms, or $R_2$ and $R_3$ together and/or $R_4$ and $R_5$ together represent alkylene having 4 or 5 carbon atoms, and, if n is 1, $R_1$ represents phenyl, naphthyl, phenylethyl, benzyl or cyclohexyl, alkyl which has 1 to 4 carbon atoms and which is optionally substituted by halogen, hydroxyl or alkoxy having 1 to 4 carbon atoms, or $R_1$ represents acyl having 1 to 4 carbon atoms, alkoxycarbonyl having 2 to 5 carbon atoms or hydrogen, and $R_2$ and $R_3$ each have the meanings given for $R_1$, or $R_2$ and $R_3$ together represent alkylene having 4 or 5 carbon atoms, with at most two of the radicals $R_1$, $R_2$ and $R_3$ representing hydrogen; and subjecting the materials treated in this manner to a heat treatment.

If the sulphurylamides of the formula (1) are present as ammonium salts, these can be for example ammonium salts substituted with cyclohexyl or in particular with hydroxyalkyl, or especially with alkyl, each having 1 to 4 carbon atoms. Examples of such salts which may be mentioned are the ammonium salts of cyclohexyl, 2-ethylcyclohexyl, dimethylhydroxyethyl, diethylhydroxyethyl, dimethyl, diethyl, n-butyl and ethyl. The unsubstituted ammonium salt is however preferred to these substituted ammonium salts.

The compounds of the formula (1) are disulphurylamides if n is 2, and monosulphurylamides if n is 1. The monosulphurylamides are preferred to the disulphurylamides. Disulphurylamides preferably contain methyl and ethyl radicals as alkyl radicals $R_2$ to $R_5$. Preferred monosulphurylamides correspond to the formula

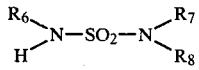

(2)

wherein $R_6$ represents phenyl, naphthyl, phenylethyl, benzyl or cyclohexyl, alkyl which has 1 to 4 carbon atoms and which is optionally substituted by halogen, hydroxyl or alkoxy having 1 to 4 carbon atoms or $R_6$ represents hydrogen; and $R_7$ and $R_8$ each have the meanings given for $R_6$; or $R_2$ and $R_3$ together represent alkylene having 4 or 5 carbon atoms, with at most two of the radicals $R_6$, $R_7$ and $R_8$ representing hydrogen. Sulphurylamides of the formula (1) which do not correspond to the sulphurylamides of the formula (2) are likewise suitable for use in the process according to the invention.

Sulphurylamides preferably used are those of the formula

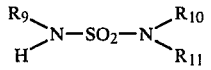

(3)

wherein $R_9$ represents phenyl, naphthyl, benzyl, phenylethyl or cyclohexyl, alkyl having 1 to 4 carbon atoms, halogenoalkyl having 3 carbon atoms or hydrogen, $R_{10}$ and $R_{11}$ each have the meanings given for $R_9$, or together they represent alkylene having 4 or 5 carbon atoms, with at most 2 of the radicals $R_9$, $R_{10}$ and $R_{11}$ representing hydrogen.

Of particular interest are sulphurylamides of the formula

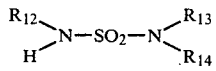

(4)

wherein $R_{12}$, $R_{13}$ and $R_{14}$ each represent phenyl, benzyl, cyclohexyl, alkyl having 1 to 4 carbon atoms, bromoalkyl having 3 carbon atoms, or hydrogen, with at most 2 of the radicals $R_{12}$, $R_{13}$ and $R_{14}$ representing hydrogen.

In the definitions of the R radicals, halogen preferably represents chlorine or especially bromine. Alkyl radicals are, for example, n-butyl, tert.-butyl, sec.-butyl, isobutyl, n-propyl, isopropyl, ethyl or methyl. Alkoxy is, for example, n-butoxy, tert.-butoxy, isobutoxy, n-propoxy, isopropoxy, ethoxy or, in particular, methoxy. Alkyl radicals substituted with alkoxy preferably contain a total of 2 to 6 carbon atoms. Alkyl radicals substituted with halogen, particularly with bromine, preferably contain 3 carbon atoms and 1 or 2 halogen atoms. Where $R_2$ and $R_3$ or $R_4$ and $R_5$ together represent alkylene, they form together with the nitrogen atom to which they are bound a hetero ring, e.g. a piperidine or pyrrolidine ring.

The following specific representatives are listed in Tables I and II as examples of suitable sulphurylamides of the formula (1).

TABLE I

| | Radicals in the formula (1) wherein n is 1 | | |
|---|---|---|---|
| No. | $R_1$ | $R_2$ | $R_3$ |
| 1 | 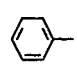 | 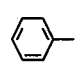 | —H |
| 2 | 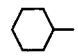 | 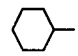 | —H |
| 3 | 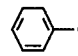 —$CH_2$— | 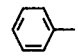 —$CH_2$— | —H |
| 4 | -n-$C_4H_9$ | -n-$C_4H_9$ | —H |
| 5 | —$CH_2$—CH(Br)—$CH_2$(Br) | —$CH_3$ | —$CH_3$ |
| 6 | 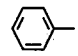 | —$(CH_2)_5$— | |
| 7 | -n-$C_4H_9$ | —H | —H |
| 8 | 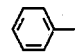 —$CH_2$— | —H | —H |
| 9 | —H | —$CH_3$ | —$CH_3$ |
| 10 | 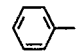 | —$CH_3$ | —$CH_3$ |

TABLE I-continued

| No. | Radicals in the formula (1) wherein n is 1 | | |
|---|---|---|---|
| | $R_1$ | $R_2$ | $R_3$ |
| 11 | 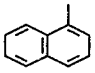 | $-CH_3$ | $-CH_3$ |
| 12 | $-CH_2CH_2-O-CH_3$ | $-CH_2CH_2-O-CH_3$ | $-H$ |
| 13 | 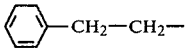 | $-H$ | H |
| 14 | 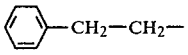 | 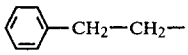 | $-H$ |
| 15 | $CH_3-CH_2O-CO-$ | $CH_3-CH_2O-CO-$ | $-H$ |
| 16 | $CH_3-CO-$ | $CH_3-CO-$ | $-H$ |
| 17 | $CH_3-CH_2-CH_2-CO-$ | $-H$ | $-H$ |
| 18 | 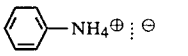 | $-CH_3$ | $-CH_3$ |
| 19 | 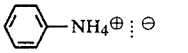 | 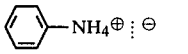 | $-H$ |
| 20 | $-NH_4^{\oplus} \vdots \ominus$ | $-CH_3$ | $-CH_3$ |

TABLE II

| No. | Radicals in the formula (1) wherein n is 2 | | | | |
|---|---|---|---|---|---|
| | $R_2$ | $R_3$ | $R_4$ | $R_5$ | $A_1$ |
| 21 | $-CH_3$ | $-CH_3$ | $-CH_3$ | $-CH_3$ | $-CH_2-CH_2-$ |
| 22 | $-CH_2-CH_3$ | $-CH_2-CH_3$ | $-CH_2-CH_3$ | $-CH_2-CH_3$ | 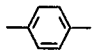 |

Particularly advantageous results are obtained with the compound No. 2 in Table I.

The sulphurylamides of the formula (1) are known or are produced by known methods, e.g.:

(a) by reaction of 1 mole of $SO_2Cl_2$ with 2 moles of a primary amine, in the presence of 2 moles of an acid acceptor (e.g. triethylamine or the amine used for the reaction) in an inert solvent;

(b) by reaction of 2 moles of sulphochloride of the formula

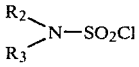

(5)

and/or

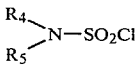

(6), wherein $R_2$, $R_3$, $R_4$ and $R_5$ have the given meanings, with 1 mole of a diamine of the formula $$H_2N-A_1-NH_2 \quad (7),$$

wherein $A_1$ has the given meanings, in the presence of 2 moles of an acid acceptor (as under a) in an inert solvent, or by reaction of 1 mole of a sulphochloride of the formula (5) with 1 mole of a primary amine, in the presence of 1 mole of an acid acceptor;

(c) by transamidation of 1 mole of sulphurylamide with 1 mole of a primary amine with the splitting-off of ammonia; or (d) by acylation of 1 mole of sulphurylamide with 1 or 2 moles of an acid anhydride or of an acid halide. After the reaction has been performed in the case of allylamine, it is possible to perform also bromination of the double bond, for which purpose preferably the purified N,N-dialkyl-N'-allylsulphamide is dissolved in chloroform and reacted for example at −10° C. to +10° C. with 1 mole of $Br_2$.

The sulphurylamides can be converted, by being taken up for example in ammonia, into the corresponding ammonium salts.

The sulphurylamides of the formula (1) are liquid or, for the most part, solid compounds which are soluble or insoluble in water. Products soluble in water are applied from aqueous solutions to the fiber materials, whilst products insoluble in water are applied from aqueous emulsions (if the products are liquid) or from aqueous dispersions (if the products are solid) to the said materials. Furthermore, products insoluble in water may be applied also from an organic solution. With the application of water-insoluble sulphurylamides from an aqueous emulsion or dispersion, there are preferably concomitantly used emulsifiers or dispersing agents of the types commonly used in the dyestuff and textile industries, e.g. lignin sulphonates, aromatic sulphonic acids, saturated-aliphatic dicarboxylic acids substituted with higher alkyl radicals, condensation products from aromatic sulphonic acids and formaldehyde, alkylphenol/ethylene oxide adducts, ethylene oxide adducts from fatty acids, fatty amines or fatty alcohols, sulphurated substituted benzimidazoles and sulphonated fatty acid amides. Good results are obtained in particular with lignin sulphonates, with ethylene oxide adducts from alkylphenols, fatty amines, fatty alcohols or fatty acids, and especially with substituted benzimidazoles or with condensation products from aromatic sulphonic acids and formaldehyde.

There are preferably employed those dispersing agents which at elevated temperature, e.g. at 180° C. to 220° C., cause no yellowing of the treated substrate, or at most a yellowing that can be removed by subsequent washing. In other words, the dispersing agents either should not decompose at elevated temperature or should merely form soluble or volatile decomposition products. The amount of dispersing agent is preferably between 1 and 60 percent by weight, relative to the sulphurylamide. Particularly good results are obtained with 1 to 50, especially with 1 to 20, and especially with 1 to 4, percent by weight of dispersing agent, relative to the sulphurylamide.

In order to increase storage stability, the aqueous suspensions or dispersions can also contain a protective colloid. The protective colloids customarily employed in industry are suitable, such as polyvinyl alcohol, polyvinylpyrrolidone, methylcellulose, carboxymethylcellulose, hydroxyethyl cellulose or hydroxypropylcellulose, gelatine, acid casein, starch paste or polymers of monomers of the acrylic acid series, such as polyacrylic acid, ethyl acrylate copolymers or methyl methacrylate copolymers. Good results are obtained in particular with polyvinyl alcohol, hydroxyethylcellulose and especially with carboxymethylcellulose.

The aqueous preparations contain as a rule 50 to 700 g/kg, preferably 200 to 700 g/kg, particularly 200 to 500 g/kg, of sulphurylamide; 0 to 300 g/kg, preferably 0.2 to 200 g/kg, especially 5 to 40 g/kg, of dispersing agent; and 0 to 30 or 0.5 to 30 g/kg, preferably 0 to 10 or 0.5 to 10 g/kg, of protective colloid. The amount is made up each time with water to 1 kg.

The preferred solid sulphurylamide of the formula (1) is advantageously ground as an aqueous dispersion in the presence of a dispersing agent to the extent that the particles have a mean diameter of 1 to 30μ, preferably 0.5 to 30μ, especially 1 to 20μ. Good results are obtained in particular with dispersions of which the particle size is 1 to 10μ, preferably 0.5 to 10μ, and especially 0.5 to 5μ. The particle size in itself has no influence on the attainable fireproofing effects, but it does influence the stability of the dispersions.

The sulphurylamides wet in different ways, so that it can be advantageous to suspend them in water not immediately before application but well beforehand. Pure suspensions are however relatively unstable. A dispersing agent is therefore preferably added to the aqueous preparation, since this prevents a rapid sedimentation of the solid sulphurylamide. This sedimentation can be almost completely prevented by the further addition of a protective colloid. The protective colloids can be incorporated into the dispersion before or after grinding. Dispersions stabilised in this way can if required be converted by drying in a manner known per se, e.g. in a spray dryer or in a standard paddle dryer, into solid commercial preparations which can be redispersed at any time.

The grinding of the solid sulphurylamides is performed in customary devices suitable for such purposes, e.g. in a glass-ball mill, in a sand mill or in a corundum disk mill.

Suitable organic solvents for application of the sulphurylamides of the formula (1) from an organic sodium are aromatic hydrocarbons, e.g. benzene or toluene, particularly cycloaliphatic or heterocyclic hydrocarbons, e.g. dioxane or tetrahydrofuran, halogenated, preferably aliphatic, hydrocarbons, e.g. chloroform or trichloroethylene, and especially lower, preferably aliphatic, alcohols, e.g. methanol or ethanol, ketones, e.g. cyclohexanone, acetone or methyl ethyl ketone, esters, e.g. ethyl acetate or amides, e.g. dimethylformamide.

The process according to the invention is preferably performed by drying the fiber material after it has been treated with the aqueous fireproofing composition and subsequently subjecting the dried material to a heat treatment at elevated temperature. A suitable method comprises drying the treated material at temperatures up to 100° C., e.g. 70° to 100° C.; and then subjecting it to a heat treatment above 100° C., e.g. at 100° to 220° C., or especially at 150° to 220° C., i.e. subjecting it to a thermosol treatment.

The fireproofing composition containing the sulphurylamide of the formula (1) can be applied to the fiber materials by conventional methods, e.g. by spraying or printing, or preferably by the exhaust process, or particularly by padding.

The thermosol process is preferably performed at 175° to 220° C., and takes as a rule 10 to 200 seconds, preferably 20 to 100 seconds. Particularly good results are achieved with a time of 10 to 60 seconds.

Instead of being padded or subjected to the thermosol treatment, the materials may also be finished by the exhaust process under high-temperature conditions, e.g. at 100° C. to 130° C.

The process according to the invention is performed preferably in such a manner that, by suitable dilution of the fireproofing composition with water or with organic solvent, depending on the type of fiber material and on its weight per unit area, the deposit of sulphurylamide of the formula (1), relative to the fiber material treated, is 1 to 20 percent by weight or, in particular, 1 to 10 percent by weight.

The polyester fiber materials rendered fireproof according to the invention can be in any stage of processing, i.e. they can be treated in the form of staple or continuous filaments, or of fabrics or knitwear, in the dyed or undyed state, or in the form of textiles that have already been further processed. Preferably, however, the material to be treated is always textile fiber material.

The polyester fiber materials to which the fireproof finish is imparted are preferably those derived from terephthalic acid, e.g. poly(ethylene glycol terephthalate).

There are obtained according to the invention on polyester fiber materials permanent fireproofing effects which are retained even after repeated washing or dry cleaning. The resulting finishes furthermore have the advantage that the handle of the fireproofed fiber materials is not found to be tacky. Moreover, the proneness of the fabrics to become soiled in the dry state and in the wet state is not increased. The fastness to light and to rubbing of dyeings is scarcely affected.

A particular advantage of the process according to the invention is that good fireproofing effects are obtained with small deposited amounts.

The textile-mechanical properties of the treated fiber materials are moreover negligibly impaired as a result of the present fireproofing finish. The same applies to the low stiffness in flexure and to the high resistance to abrasion and ultimate tensile strength of the finished fiber materials.

Even fabrics printed with disperse dyes can be treated according to the invention without the quality of the printing becoming impaired.

The process according to the invention can be performed also simultaneously with a process for dyeing or brightening.

Percentage values in the following Examples are percent by weight.

Instructions for producing dispersions 200 g of sulphurylamide of the formula (1) is suspended in a solution of 4 g of the sodium salt of a condensation product of naphthalenesulphonic acid and formaldehyde and 2 g of carboxymethylcellulose in 194 g of water. Grinding is performed in a sand mill until the mean particle size is down to 5μ. There is thus obtained a dispersion which is readily pourable and dilutable.

EXAMPLE 1

Blue-dyed polyester fabrics having a weight per unit area of 150 g/m$^2$ are padded with the aqueous liquors according to the following Table III, dried for 30 minutes at about 80° C., and subsequently subjected to the thermosol treatment for 20 seconds at 200° C.

The fabric is then washed for 5 minutes at 60° C. in a liquor containing per liter 2 g of anhydrous sodium carbonate and 1 g of a condensation product from 1 mole of p-nonylphenol and 9 moles of ethylene oxide. The material is subsequently rinsed and dried.

The fixation degree indicates the amount of product present on the fiber material after the subsequent washing treatment (relative to the amount present after the thermosol treatment).

The fabrics are afterwards washed for 45 minutes at 60° C., in a domestic washing machine, in a liquor containing per liter 4 g of a household detergent (SNV 198 861–washing).

The individual fabric specimens are then tested with respect to their fireproof property (DIN 53 906, ignition time 3 seconds).

The results are given in the following Table III.

TABLE III

| | | un-treated | Treated with liquor | | | | | | | | | | | | | | | |
|---|---|---|---|---|---|---|---|---|---|---|---|---|---|---|---|---|---|---|
| | | | A | B | C | D | E | F | G | H* | I* | J* | K | L | M | N | O | P** |
| product No. according to Table 1, % in dispersion: | 1 | | 27,5 | 27,5 | | | | | | | | | | | | | | |
| | 2 | | | | 25 | 25 | | | | | | | | | | | | |
| | 3 | | | | | | 40 | 40 | | | | | | | | | | |
| | 4 | | | | | | | | 18 | 100 | | | | | | | | |
| | 5 | | | | | | | | | | 100 | 100 | | | | | | |
| | 6 | | | | | | | | | | | | 25 | | | | | |
| | 7 | | | | | | | | | | | | | 27,5 | | | | |
| | 8 | | | | | | | | | | | | | | 27,5 | | | |
| | 10 | | | | | | | | | | | | | | | 22 | | |
| | 11 | | | | | | | | | | | | | | | | 21 | |
| | 12 | | | | | | | | | | | | | | | | | 100 |
| liquor absorption % | | | 80 | 80 | 85 | 85 | 80 | 80 | 85 | 85 | 80 | 80 | 80 | 85 | 85 | 85 | 85 | 85 |
| g of dispersion/kg of liquor | | | 227 | 454 | 352 | 704 | 235 | 470 | 490 | 88 | 94 | 188 | 375 | 321 | 321 | 800 | 888 | 68 |
| handle after subsequent washing | | 0 | 2¼ | 2½ | ½ | ½ | 0 | ½ | 0 | 1 | 0 | 1 | 1 | ½ | 0 | ½ | 1½ | ½ |
| fireproofness | | | | | | | | | | | | | | | | | | |
| after thermosol treatment | | | | | | | | | | | | | | | | | | |
| burning time | sec. | burns | 25 | 11 | 18 | 14 | 9 | 10 | 2 | 2 | 4 | 2 | 23 | 0 | 8 | 12 | 3 | 8 |
| tear length | cm. | | 8,5 | 6,5 | 10,5 | 13 | 4,5 | 4 | 8,5 | 9,5 | 5 | 4 | 8 | 5 | 8,5 | 6 | 5,6 | 7 |
| after subsequent washing | | | | | | | | | | | | | | | | | | |
| burning time | sec. | burns | 0 | 0 | 0 | 10 | 0 | 0 | 18 | 25 | 1 | 1 | 1 | 0 | 2 | 1 | 1 | 1 |
| tear length | cm. | | 5,5 | 4,5 | 6,5 | 10,5 | 4,5 | 5 | 12,5 | 14,5 | 4 | 3,5 | 4,5 | 4 | 4 | 5 | 5 | 5,5 |
| after 20 machine washings | | | | | | | | | | | | | | | | | | |
| burning time | sec. | burns | 0 | 0 | 0 | 0 | 1 | 1 | 0 | 3 | 0 | 0 | 0 | 0 | 0 | 0 | 3 | 0 |
| tear length | cm. | | 5 | 5 | 6 | 5,5 | 4,5 | 4 | 6 | 6 | 4 | 4 | 5 | 4 | 5 | 6,5 | 5 | 5,5 |
| after 40 machine washings | | | | | | | | | | | | | | | | | | |
| burning time | sec. | burns | 5 | 4,5 | 6 | 6,5 | 4,5 | 4,5 | 5,5 | 9,5 | 4 | 4,5 | 5 | — | — | 5,5 | — | 4,5 |
| tear length | cm. | | | | | | | | | | | | | | | | | |

Handle values:
0 unchanged,
1 fraction stiffer than 0,
2 somewhat stiffer than 0,
3 stiff,
4 very stiff.
*in these cases the liquors are ethanolic solutions and not dispersions; the % content of the dispersion is therefore given as 100
**since the product is soluble in water, it is not necessary to produce a dispersion

EXAMPLE 2

The procedure is carried out as in Example 1 except that the polyester fabric is padded with the liquors having the compositions given in the following Table IV.

The results of the flameproofness tests (DIN 53 906; ignition time 3 seconds) and the handle values (see Example 1) are likewise summarised in the following Table IV.

TABLE IV

| | | untreated | Treated with liquor | | | | | | | | | | | | |
|---|---|---|---|---|---|---|---|---|---|---|---|---|---|---|---|
| | | | Q | R | S | T | U | V | W* | X | Y | Z** | AA** | BB*** | CC*** |
| product No. according to Tables I and II, % in dispersion: | 5 | | 20,5 | — | — | — | — | — | — | — | — | — | — | — | — |
| | 7 | | — | 35 | — | — | — | — | — | — | — | — | — | — | — |
| | 13 | | — | — | 14 | — | — | — | — | — | — | — | — | — | — |
| | 14 | | — | — | — | 30 | 30 | — | — | — | — | — | — | — | — |
| | 15 | | — | — | — | — | — | 25 | — | — | — | — | — | — | — |
| | 16 | | — | — | — | — | — | — | 100 | — | — | — | — | — | — |
| | 17 | | — | — | — | — | — | — | — | 28 | 28 | — | — | — | — |
| | 18 | | — | — | — | — | — | — | — | — | — | 160 | — | — | — |
| | 20 | | — | — | — | — | — | — | — | — | — | — | 100 | — | — |
| | 21 | | — | — | — | — | — | — | — | — | — | — | — | 100 | 100 |
| liquor absorption % | | | 100 | 80 | 75 | 75 | 75 | 80 | 80 | 80 | 80 | 100 | 100 | 85 | 85 |
| g of dispersion/kg of liquor | | | 500 | 536 | 714 | 133 | 655 | 750 | 94 | 335 | 670 | 100 | 100 | 88 | 176 |
| handle after subsequent washing | | 0 | 1 | ½ | 1 | 1 | 1½ | ½ | 0 | 0 | 0 | 1½ | 0 | ½ | ½ |
| fireproofness | | | | | | | | | | | | | | | |

TABLE IV-continued

| | | | Treated with liquor | | | | | | | | | | | | |
|---|---|---|---|---|---|---|---|---|---|---|---|---|---|---|---|
| | | untreated | Q | R | S | T | U | V | W* | X | Y | Z** | AA** | BB*** | CC*** |
| after thermosol treatment | | | | | | | | | | | | | | | |
| burning time | sec. | burns | 9 | 2 | 0 | 2 | 2 | 8 | 0 | 1 | 0 | 12 | 30 | 1 | 0 |
| tear length | cm. | | 7 | 6 | 5,5 | 6 | 6,5 | 6,5 | 5 | 5 | 6 | 7,5 | 12,5 | 6,5 | 7 |
| after subsequent washing | | | | | | | | | | | | | | | |
| burning time | sec. | burns | 2 | 0 | 1 | 5 | 3 | 0 | 0 | 0 | 0 | 3 | 20 | 1 | 7 |
| tear length | cm. | | 6 | 5 | 5 | 5,5 | 6 | 5 | 5 | 5 | 5,5 | 6 | 10 | 5,5 | 7 |
| after 1 machine washing | | | | | | | | | | | | | | | |
| burning time | sec. | burns | 0 | 0 | 1 | 5 | 3 | 0 | 0 | 0 | 0 | 2 | 6 | 0[a] | 2[a] |
| tear length | cm. | | 5 | 5,5 | 5 | 6 | 6 | 5,5 | 5 | 5,5 | 5 | 6 | 7 | 5[a] | 6[a] |
| after 10 machine washings | | | | | | | | | | | | | | | |
| burning time | sec. | burns | 4 | 0 | 1 | 5 | 6 | 0 | 0 | 0 | 0 | 0 | 3 | 0[b] | 2[b] |
| tear length | cm. | | 4,5 | 5 | 5 | 5,5 | 6 | 5,5 | 6 | 5 | 5,5 | 6 | 6,5 | 5,5[b] | 5,5[b] |

[a]after 20 machine washings,
[b]after 40 machine washings
*this is an ethanolic solution and not a dispersion; the % content of the dispersion is therefore given as 100
**since these products are soluble in water, it is not necessary to produce dispersions
***not a dispersion but solutions in dimethylformamide with the percent content being given as 100

Similar results are obtained with the products Nos. 9 and 19 according to Table I, and No. 22 according to Table II.

We claim:

1. A fireproofing composition, which contains at least (a) one substituted sulphurylamide of the formula

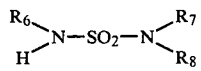

wherein $R_6$ is phenyl, naphthyl, phenylethyl, benzyl, cyclohexyl or hydrogen: and $R_7$ and $R_8$ each have the meanings given for $R_6$, with at most two of the radicals $R_6$, $R_7$ and $R_8$ being hydrogen, and (b) a dispersing agent selected from the group consisting of lignin sulphonates, aromatic sulphonic acids, saturated-aliphatic dicarboxylic acids substituted with higher alkyl radicals, condensation products from aromatic sulphonic acids and formaldehyde, alkylphenol/ethylene oxide adducts, ethylene oxide adducts from fatty acids, fatty amines or fatty alcohols, sulphurated substituted benzimidazoles and sulphonated fatty acid amides.

2. A composition of claim 1, which further contains (c) a protective colloid.

3. A composition of claim 2, which contains per kg 50 to 700 g of the sulphurylamide, 0.2 to 200 g of dispersing agent and 0 to 300 g of protective colloid.

4. A composition of claim 1, which further contains (d) water.

5. A composition of claim 1, wherein is used a sulphurylamide of the formula

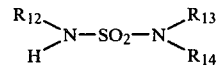

wherein $R_{12}$, $R_{13}$ and $R_{14}$ each are phenyl, benzyl, cyclohexyl or hydrogen, with at most 2 of the radicals $R_{12}$, $R_{13}$ and $R_{14}$ being hydrogen.

6. A composition of claim 1, wherein is used a sulphurylamide of the formula

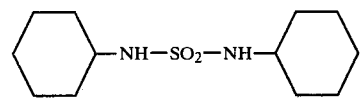

7. A composition of claim 1, wherein the sulphurylamide is present in powder form and has a mean particle diameter of 1 to 30μ.

8. A composition of claim 1, wherein is used a sulphurylamide of the formula

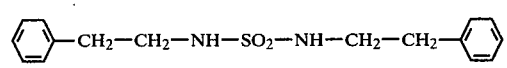

* * * * *